US006594464B2

(12) United States Patent
Hayashi et al.

(10) Patent No.: US 6,594,464 B2
(45) Date of Patent: Jul. 15, 2003

(54) IMAGE FORMING APPARATUS INCLUDING ENDLESS BELT WITH REDUCED HEAT LOSS

(75) Inventors: Shohji Hayashi, Yokohama (JP); Tadao Uehara, Kakogawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/974,901

(22) Filed: Oct. 12, 2001

(65) Prior Publication Data

US 2002/0044806 A1 Apr. 18, 2002

(30) Foreign Application Priority Data

Oct. 13, 2000 (JP) ..... 2000-314302

(51) Int. Cl.[7] ..... G03G 15/20

(52) U.S. Cl. ..... 399/325; 219/216; 399/327; 399/329

(58) Field of Search ..... 399/324–329; 432/60; 219/216

(56) References Cited

U.S. PATENT DOCUMENTS

| | | | | |
|---|---|---|---|---|
| 5,666,623 A | | 9/1997 | Yamada et al. | 399/325 X |
| 5,794,105 A | * | 8/1998 | Tamaoki et al. | 399/329 X |
| 5,890,047 A | | 3/1999 | Moser | 399/329 |
| 5,991,562 A | * | 11/1999 | Ito et al. | 399/325 X |
| 6,055,390 A | | 4/2000 | Kurotaka et al. | 399/329 X |
| 6,091,926 A | * | 7/2000 | Yamada | 399/329 |
| 6,118,955 A | | 9/2000 | Yoneda et al. | 399/329 X |
| 6,137,983 A | * | 10/2000 | Okabayashi et al. | 399/329 |
| 6,137,984 A | * | 10/2000 | Higashi et al. | 399/329 |
| 6,282,398 B1 | * | 8/2001 | Higashi | 399/329 |
| 6,327,456 B1 | * | 12/2001 | Higaya | 399/328 X |
| 6,351,619 B1 | * | 2/2002 | Yamada | 399/329 X |

FOREIGN PATENT DOCUMENTS

| | | |
|---|---|---|
| JP | 9-218601 | 8/1997 |
| JP | 10-221982 | 8/1998 |

OTHER PUBLICATIONS

European Search Report.

* cited by examiner

*Primary Examiner*—William J. Royer
(74) *Attorney, Agent, or Firm*—Oblon, Spivak, McClelland, Maier & Neustadt, P.C.

(57) ABSTRACT

A fixing device for an image forming apparatus includes a heat roller, a fixing roller, an endless belt passed over the heat roller and fixing roller and driven to turn, a press roller pressed against the fixing roller with the intermediary of the endless belt. A recording medium is passed between the belt and the press roller. The fixing device additionally includes at least one contact member contacting the belt. Part of the at least one contact member is formed of at least one of heat-resistant felt or heat-resistant resin. The contact member contacts the surface of part of the belt contacting the heat roller.

8 Claims, 7 Drawing Sheets

IMAGE FORMING APPARATUS INCLUDING ENDLESS BELT WITH REDUCED HEAT LOSS

BACKGROUND OF THE INVENTION

1. Field of the Invention

The present invention relates to a fixing device of the type including a heat roller, a fixing roller, an endless belt passed over the heat roller and fixing roller, a press roller pressed against the fixing roller and one or more contact members contacting the belt and fixing a toner image carried on a recording medium by passing the recording medium between the belt and the press roller, and an image forming apparatus including the same.

2. Description of the Background Art

A fixing device of the type described is usually included in a copier, printer, facsimile apparatus or similar electrophotographic image forming apparatus or a multifunction apparatus having two or more of a copier function, a printer function and a facsimile function, as taught in, e.g., Japanese Patent Laid-Open Publication No. 8-334997. An endless belt included in the fixing device has a thermal capacity small enough to heat the belt in a short period of time. This reduces the warm-up time of the fixing device. However, contact members contacting the belt take heat from the belt and are therefore apt to obstruct the heating of the belt, i.e., the warm-up of the fixing device.

Technologies relating to the present invention are also disclosed in, e.g., Japanese Patent Laid-Open Publication Nos. 9-218601, 10-221982 and 2000-305393.

SUMMARY OF THE INVENTION

It is an object of the present invention to provide a fixing device capable of effectively reducing the amount of heat that an endless belt loses due to contact members and thereby reducing the warm-up time more than conventional fixing devices, and an image forming apparatus including the same.

A fixing device of the present invention includes a heat roller, a fixing roller, an endless belt passed over the heat roller and fixing roller and driven to turn, a press roller pressed against the fixing roller with the intermediary of the endless belt. The recording medium is passed between the belt and the press roller. The device additionally includes at least one contact member contacting the belt. Part of the at least one contact member contacting the belt is formed of at least one of heat-resistant felt and heat-resistant resin. The at least one contact member may contact the surface of part of the belt contacting the heat roller.

An image forming apparatus including the above-described fixing device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
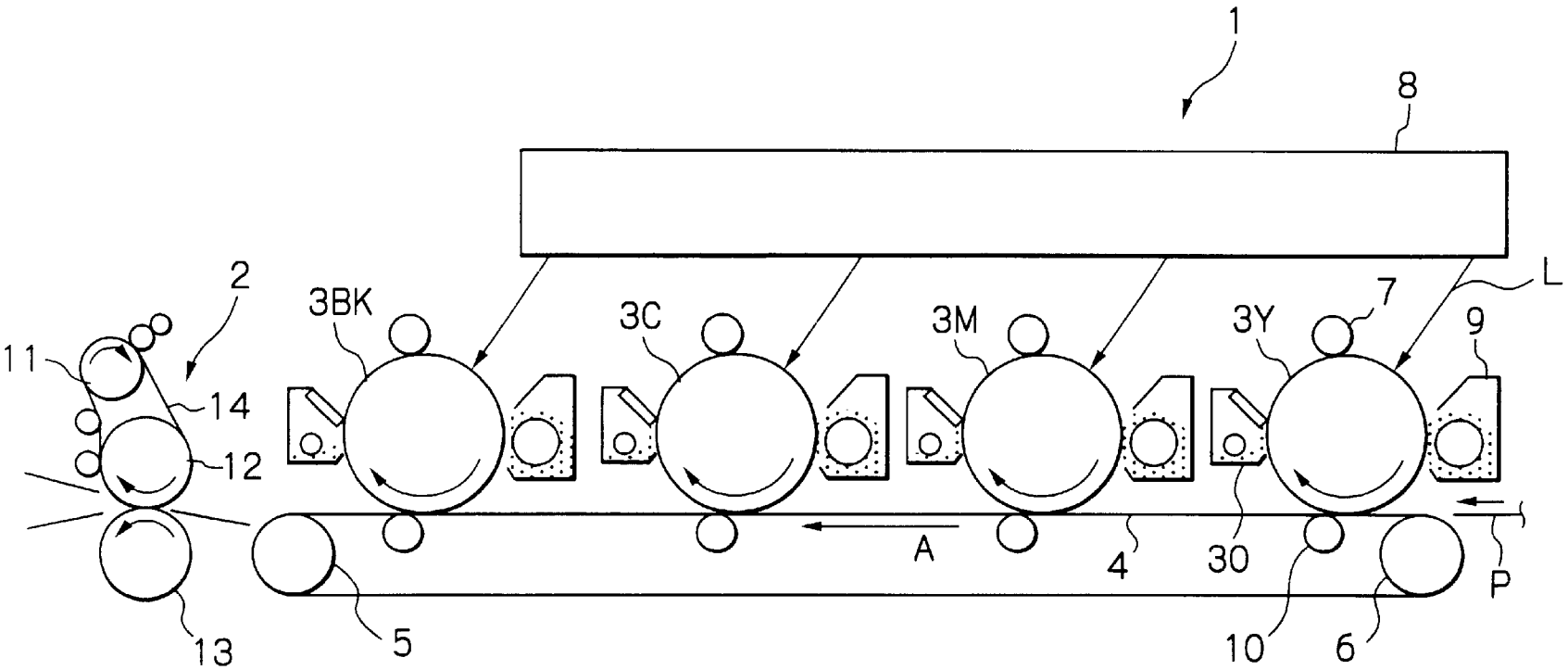
FIG. 1 is a view showing an image forming apparatus which the present invention is applied.

Referring to FIG. 1 of the drawings, an image forming apparatus to which the present invention is applied is shown and implemented as a color printer by way of example. As shown, the color printer is generally made up of image forming means 1 for forming a toner image on a recording medium and a fixing device 2 for fixing the toner image on the recording medium.

The image forming means 1 includes first to fourth photoconductive drums 3Y, 3M, 3C and 3BK, which are a specific form of an image carrier. A yellow, a magenta, a cyan and a black toner image are formed on the drums 3Y, 3M, 3C and 3BK, respectively. An image transfer belt (simply belt hereinafter) 4 is passed over a drive roller 5 and a driven roller 6 and movable in a direction indicated by an arrow A in FIG. 1. The upper run of the belt 4, as viewed in FIG. 1, faces the drums 3Y through 3BK. Because the configurations and operations for forming toner images on the drums 3Y through 3BK are identical, the following description will concentrate on the configuration and operation of forming a toner image on the drum 3Y by way of example.

While the drum 3Y is rotated clockwise, as viewed in FIG. 1, a charge roller 7 uniformly charges the surface of the drum 3Y to a preselected polarity. A laser writing unit 8 scans the charged surface of the drum 3Y with a laser beam L modulated in accordance with image data, thereby forming a latent image on the drum 3Y. A developing device 9 develops the latent image with yellow toner to thereby produce a corresponding yellow toner image.

A paper sheet or similar recording medium P is fed from a sheet feed section, not shown, to a nip between the drum 3Y and the belt 4. An image transfer roller 10 faces the image carrier 3Y with the intermediary of the belt 4 and is applied with a bias opposite in polarity to the toner deposited on the drum 3Y. The bias transfers the yellow toner image from the drum 3Y to the paper sheet P. A drum cleaner 30 removes the toner left on the drum 3Y after the image transfer.

A magenta, a cyan and a black toner image are respectively formed on the drums 3M, 3C and 3BK in exactly the same manner as the yellow toner image. The magenta, cyan and black toner images are sequentially transferred to the paper sheet P over the yellow toner image, completing a full-color color image. The paper sheet P with the full-color image is conveyed to the fixing device 2. The paper fixing device 2 fixes the full-color image on the paper sheet P. Thereafter, the paper sheet or color print P is out to a tray, not shown.

Figure 2:
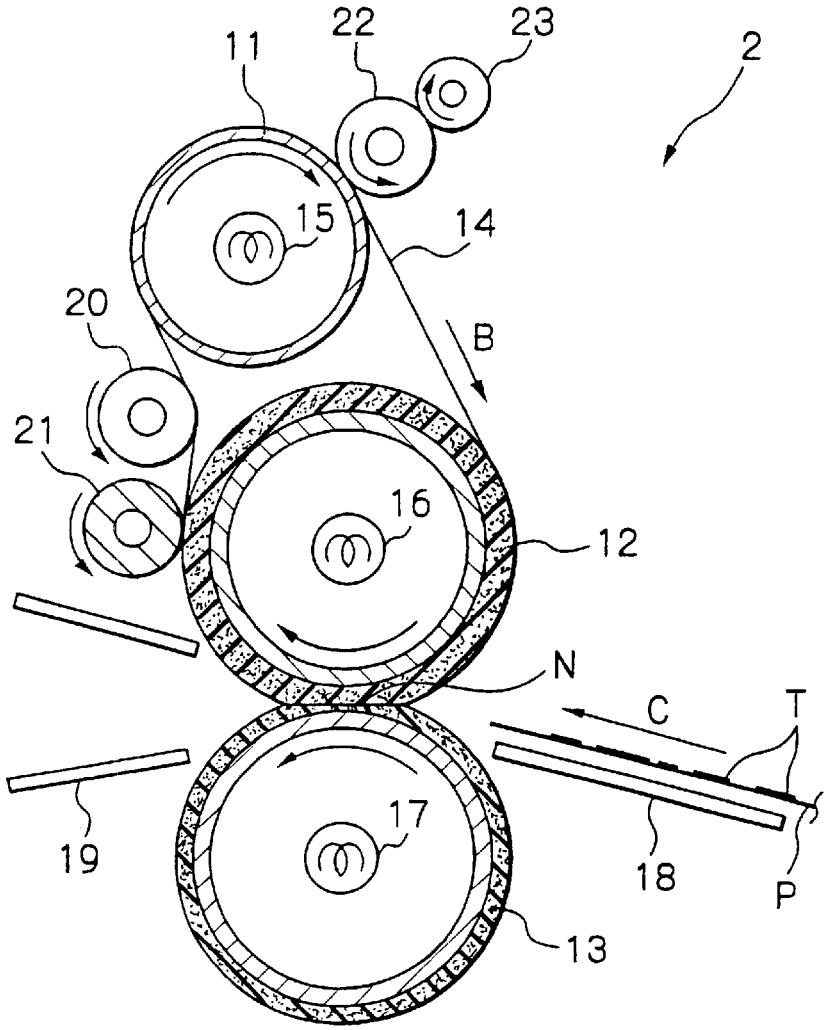
FIG. 2 is a sectional view showing a fixing device embodying the present invention and included in the apparatus of FIG. 1.

As shown in FIG. 2 in detail, the fixing device 2 embodying the present invention includes a heat roller 11, a fixing roller 12 and a press roller 13 that are substantially parallel to each other. An endless belt 14 is passed over the heat roller 11 and fixing roller 12. The heat roller 11 is a hollow, cylinder formed of aluminum or similar metal and provided with a thin wall thickness. The fixing roller 12 is made up of, e.g., a hollow, cylindrical core having a thin wall and a silicone rubber layer covering the outer circumference of the core. The press roller 13 is also made up of, e.g., a hollow, cylindrical core having a thin wall and a silicone rubber layer covering the outer circumference of the core.

The belt 14 is made up of a base and a surface layer or parting layer covering the surface of the base. The base is formed of nickel, stainless steel or similar metal or polyimide resin or similar resin. The parting layer is formed of silicone rubber by way of example. The base contacts the heat roller 11 and fixing roller 12.

The heat roller 11, fixing roller 12 and press roller 13 are journalled to a frame, not shown, included in the fixing device 2. The press roller 13 is pressed against the fixing roller 12 with the intermediary of the belt 14. Drive means, not shown, causes the fixing roller 12 and press roller 13 to rotate in opposite directions to each other, as indicated by arrows in FIG. 1. The belt 14 therefore runs in a direction indicated by an arrow B, as shown in FIG. 2, while causing the heat roller 11 to rotate in a direction indicated by an arrow.

Heaters or heat sources 15, 16 and 17 are disposed in the heat roller 11, fixing roller 12 and press roller 13, respectively. At least one of the heaters 16 and 17 may be omitted, if desired. The heater 15 may be positioned outside of the heat roller 11. Further, use may be made of a heat roller formed integrally with a heat source such that the heat roller itself heats. This is also true with the heat sources for heating the fixing roller 12 and press roller 13.

In operation, the heat roller 11, fixing roller 12, press roller 13 and belt 14 are driven in the manner stated above. The heaters 15, 16 and 17 heat the heat roller 11, fixing roller 12 and press roller 13, respectively. Heat is transferred from the rollers 11 through 13 to the belt 14, so that the belt 14 is heated to a temperature suitable for fixing the toner image. In this condition, the paper sheet P carrying a toner image T thereon enters a nip N along an inlet guide 18, as indicated by an arrow C, as shown in FIG. 2. The toner image T is brought into contact with the belt 14. At the nip, the fixing roller 12 and press roller 13 are pressed against each other with the intermediary of the belt 14. As a result, the toner image T is melted by heat and fixed on the paper sheet P. The paper sheet P coming out of the above nip N is conveyed along an outlet guide 19. When the parting layer of the belt 14 is implemented by silicone rubber, it enhances the loss and therefore quality of the fixed color image.

The fixing device 2 additionally includes one or more contact members contacting the belt 14. In the illustrative embodiment, a tension roller 20, a cleaning roller 21 and a coating roller 22 contact the outer surface of the belt 14. The tension roller 20 applies tension to the belt 14 while the cleaning roller 21 cleans the surface of the belt 14. The coating roller 22 coats silicone oil or similar anti-offset liquid on the surface of the belt 14. These rollers 20 through 22 are also journalled to the frame of the fixing device 2 and driven by the belt 14. The rollers 20 through 22 may be positively driven by drive means, if desired.

A liquid feed roller 23 is held in contact with the coating roller 22 and journalled to the frame of the fixing device 2. The liquid feed roller 23, which is also driven by the belt 14, feeds the anti-offset liquid to the surface of the coating roller 22. The anti-offset liquid is then transferred from the coating roller 22 to the belt 14, preventing the offset of the toner from the paper sheet P to the belt 14. Even if some toner is transferred from the paper sheet P to the belt 14, the cleaning roller 21 pressed against the belt 14 successfully removes the toner and thereby prevents the toner from depositing on the paper sheet P and smearing it.

The tension roller 20 presses the outer surface of the belt 14 in order to constantly maintain the belt 14 in a stretched position. In addition, the tension roller 20 serves to remove the toner, which the cleaning roller 21 failed to remove, from the belt 14. The tension roller 20 is positioned downstream of the nip N in the direction of movement of the belt 14, but upstream of the coating roller 22. Therefore, part of the belt 14 moved away from the tension roller 20 and where no toner exists is brought to the coating roller 22. The coating roller 22 is therefore protected from contamination that would deteriorate the anti-offset function of the coating roller 22.

The belt 14 has a thermal capacity small enough to accelerate the warm-up of the fixing device 2. More specifically, at the time of power-up, for example, current is fed to the heaters 15 through 17 in order to start heating the belt 14 via the rollers 11 through 13. At this instant, such a small thermal capacity of the belt 14 reduces a period of time necessary for the belt 14 to reach a preselected fixing temperature. By contrast, in a fixing device of the type having a fixing roller with a surface layer formed of silicone rubber and a press roller directly pressed against each other, the thickness and therefore thermal capacity of the surface layer is great and increases the warm-up time to about 7 minutes or so.

However, the problem with a conventional fixing device using a belt is that contact members contacting the belt have high thermal conductivity and therefore great thermal capacity and therefore take heat from the belt at the time of warm-up, as discussed earlier. This prevents the warm-up time from being reduced to a noticeable degree. More specifically, assume a conventional fixing device also having the configuration shown in FIG. 2. Then, it has been customary to implement the tension roller 20 by an aluminum core and a silicone rubber layer covering the core. In this case, at the time of warm-up, the silicone rubber layer takes much heat from the belt 14 and slows down the warm-up.

In light of the above, in the illustrative embodiment, at least one of the contact members contacting the belt 14 has a surface formed of at least on of heat-resistant felt or heat-resistant resin. Preferably, at least one of the tension roller 20 or the cleaning roller 21 should have a surface formed of at least one of heat-resistant felt or heat-resistant resin.

Figure 3:
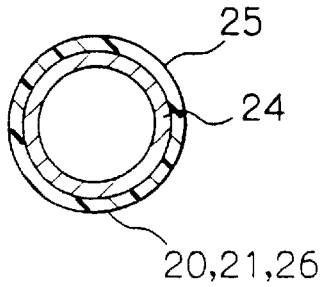
FIG. 3 is a sectional view showing a tension roller or a cleaning roller included in the illustrative embodiment or a tension/cleaning roller included in a modification thereof.

FIG. 3 shows a specific configuration of each of the cleaning roller 21 and tension roller 20. As shown, the roller 20 or 21 is made up of a hollow, cylindrical core 24 formed of aluminum or similar metal and a surface layer 25 covering the outer circumference of the core 24. The surface layer 25, which is to contact the belt 14, is formed of heat-resistant resin, e.g., Teflon (trade name). Alternatively, the entire roller 20 or 21 may be formed of heat-resistant resin. Further, the surface layer 25 of the roller 20 and 21 may be formed of heat-resistant felt. In this manner, at least part of the roller 20 and 21 that contacts the belt 14, e.g., the surface layer 25 in FIG. 3 is formed of at least one of heat-resistant felt or heat-resistant resin. Heat-resistant felt and heat-resistant resin both have lower thermal conductivity and therefore smaller thermal capacity than silicone rubber. The roller 20 and 21 therefore does not take as much heat from the belt 14 when contacting the belt 14. This successfully accelerates the temperature elevation of the belt 14 and therefore reduces the warm-up time of the fixing device 2.

Assume that the surface layer 25 of the cleaning roller 21 is formed of heat-resistant resin. Then, a blade, not shown, may be pressed against the surface layer 25 in order to scrape off the toner deposited on the surface layer 25. In such a case, drive means, not shown, should preferably drive the cleaning roller 21 in order to insure the rotation of the cleaning roller 21 despite the frictional force of the blade to act on the cleaning roller 21. When the surface layer 25 is formed of heat-resistant felt, the felt should only be replaced when much toner is deposited on the felt.

In the illustrative embodiment, the coating roller 22 is formed of metal. The coating roller 22 therefore deforms little and can be uniformly pressed against the belt 14 to uniformly coat the anti-offset liquid on the belt 14. The liquid feed roller 23 is also formed of metal for the above reason. The coating roller 22 formed of metal, however, is apt to take heat from the belt 14. In light of this, at least part of the coating roller 22 expected to contact the belt 14 may also be formed of at least one of heat-resistant felt or heat-resistant resin. This is also true with the liquid feed roller 23. In the illustrative embodiment, all the contact members contacting the belt 14 are formed of a material having low thermal conductivity and small thermal capacity, effectively reducing the warm-up time of the fixing device 2.

Figure 4:
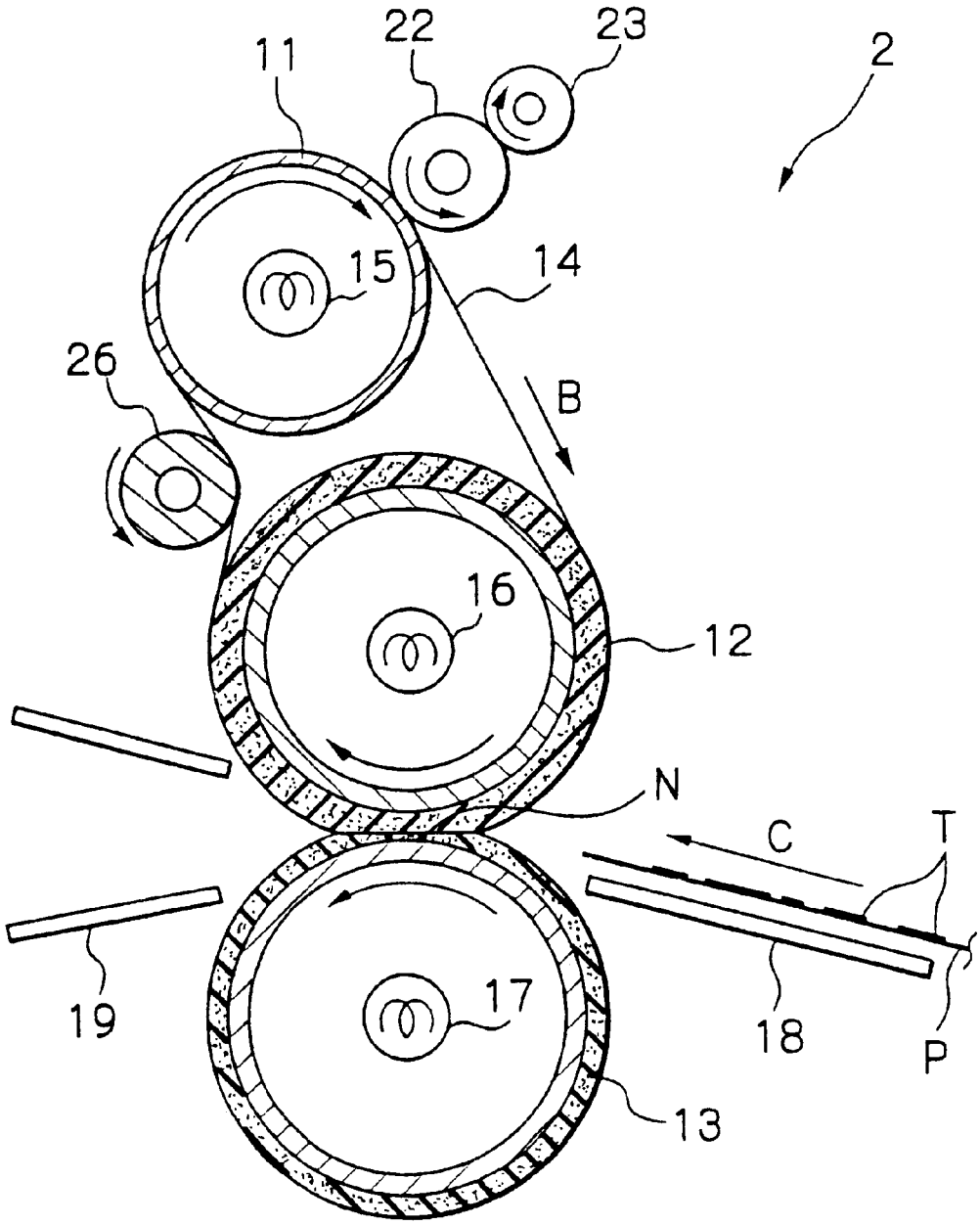
FIG. 4 is a sectional view showing a modification of the illustrative embodiment.

FIG. 4 shows a modification of the illustrative embodiment. As shown, a tension/cleaning roller 26 is pressed against the belt 14 and plays the role of the tension roller 20, FIG. 2, and that of the cleaning roller 21, FIG. 2, at the same time. More specifically, the tension/cleaning roller 26 applies tension to the belt 14 and cleans the surface of the belt 14 at the same time.

The configuration shown in FIG. 4 is practicable without regard to the material of the tension/cleaning roller 26. In the specific modification, part of the tension/cleaning roller 26 expected to contact the belt 14 is also formed of at least one heat-resistant felt or heat-resistant resin. More specifically, as shown in FIG. 3, the tension/cleaning roller 26 is also made up of the core 24 and surface layer 25 formed of Teflon or similar heat-resistant resin or heat-resistant felt. Alternatively, the entire tension/cleaning roller 26 may be formed of heat resistant resin and pressed against the belt 14. In any case, the tension/cleaning roller 26 takes a minimum of heat from the belt 14. Furthermore, the tension/cleaning roller 26 contacting the belt 14 alone reduces the warm-up time more than two rollers 20 and 21, FIG. 2, both of which contact the belt 14. Moreover, the modification reduces the number of rollers to contact the belt 14 and thereby simplifies the structure of the fixing device 2 while reducing its cost. As for the rest of the configuration, the modification is identical with the illustrative embodiment.

Figure 5:
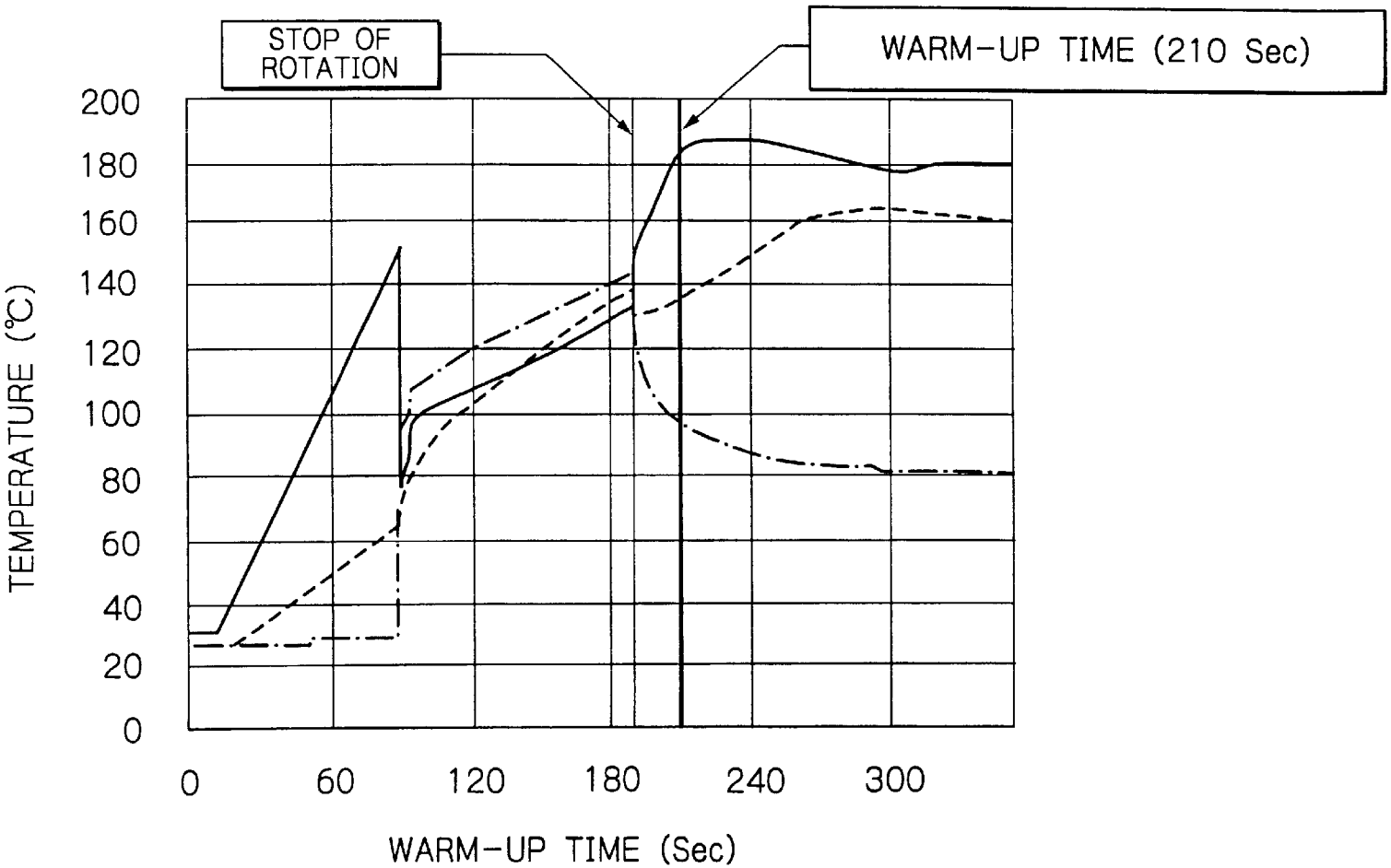
FIG. 5 is a graph showing temperature variation particular to the modification of FIG. 4 and occurring at the time of warm-up.

FIG. 5 shows experimental results relating to the warm-up of the configuration of FIG. 4 after power-up. For experiments, the liquid feed roller 23 had the configuration shown in FIG. 3 made up of the core 24 and surface layer 25 formed of heat-resistant felt. In FIG. 5, a solid curve, a dashed curve and a dash-and-dot curve respectively indicate the temperature of the heat roller 11, the temperature of the press roller 13, and the temperature of the belt 14. As for the belt 14, the temperature was measured at the inlet side of the nip N, FIG 4.

As shown in FIG. 5, on the power-up of the image forming apparatus, current begins to be fed to the heaters 15 through 17. When the heat roller 11 is heated to 150° C., the fixing roller 12 and press roller 13 held in a halt are driven in the directions indicated by arrows in FIG. 4, causing the belt 14 to start turning in the direction B. In this manner, the belt 14 is preliminarily rotated (prerotation hereinafter) and heated. On the start of the prerotation of the belt 14, the belt 14 takes heat from the heat roller 11 with the result that the temperature of the heat roller 11 is lowered. However, the temperature of the heat roller 11 again rises. When the heat roller 11 is heated to 130°, the belt 14 and press roller 13 are brought to a stop. Subsequently, when the heat roller 11 is heated to a preselected temperature (180° in this modification), the warm-up of the fixing device 2 completes. In FIG. 5, the warm-up time is 210 seconds. At this stage, the fixing roller 12 is not fully warmed up and therefore takes heat from the belt 14. As a result, the temperature of the belt 14 is lowered and held at a substantially constant value. When the belt 14 is driven in the direction of arrow B on the start of an image forming operation, part of the belt 14 held in contact with the heat roller 11 is brought to the nip N, FIG. 4. Consequently, the belt 14 is immediately heated to the temperature for fixing toner images.

Comparative examples are as follows. In one comparative example, the cleaning roller 21 included in the fixing device 2 of FIG. 2 was formed of aluminum having high thermal conductivity while the tension roller 20 was made up of a core and a silicone rubber layer having high thermal conductivity. A warm-up time measured with this comparative example was 259 seconds longer than the warm-up time achievable with the example of FIG. 5 by 40 seconds.

In another comparative example, the tension/cleaning roller 26 had a silicone rubber layer covering a core. A warm-up time measured with this comparative example was 243 seconds longer than the warm-up time achievable with the example of FIG. 4 by 33 seconds.

In a further comparative example, the entire tension/cleaning roller 26 was formed of aluminum. A warm-up time measured with this comparative example was longer than the warm-up time achievable with the example of FIG. 5 by 16 seconds.

In the comparative examples described above, the cleaning roller 21 or the tension/cleaning roller 26, formed of aluminum, was a hollow cylinder having an outside diameter of 20 mm, a wall thickness of 2.5 mm, and a length of 320 mm. The roller 21 or 26 increased the warm-up time of the fixing device 2 by about 5 seconds when solid, as determined by experiments. The tension roller 20 with the silicone rubber layer was made up of solid core formed of SUS and having a diameter of 14 mm and a 2 mm thick, silicone rubber layer formed on the core; the tension roller 20 had a diameter of 18 mm and a length of 320 mm. In the example of FIG.5, the tension/cleaning roller 26 had 2 mm thick felt in place of the silicone rubber layer.

As stated above, when part of a contact member expected to contact the belt 14 is formed of a material having a low thermal conductivity, i.e., heat-resistant felt or heat-resistant resin, the contact member takes a minimum of heat from the belt 14 and therefore reduces the warm-up time of the fixing device 2. Although no members should, in principle, contact the belt 14 in order to accelerate warm-up, such a configuration is not practicable. It is therefore preferable to reduce the thermal capacity and thermal conductivity of the contact member for thereby reducing heat that the contact member takes from the belt 14 as far as possible. The hollow core of the contact member further reduces the thermal capacity of the contact member and therefore heat that the contact member takes from the belt 14.

Figure 6:
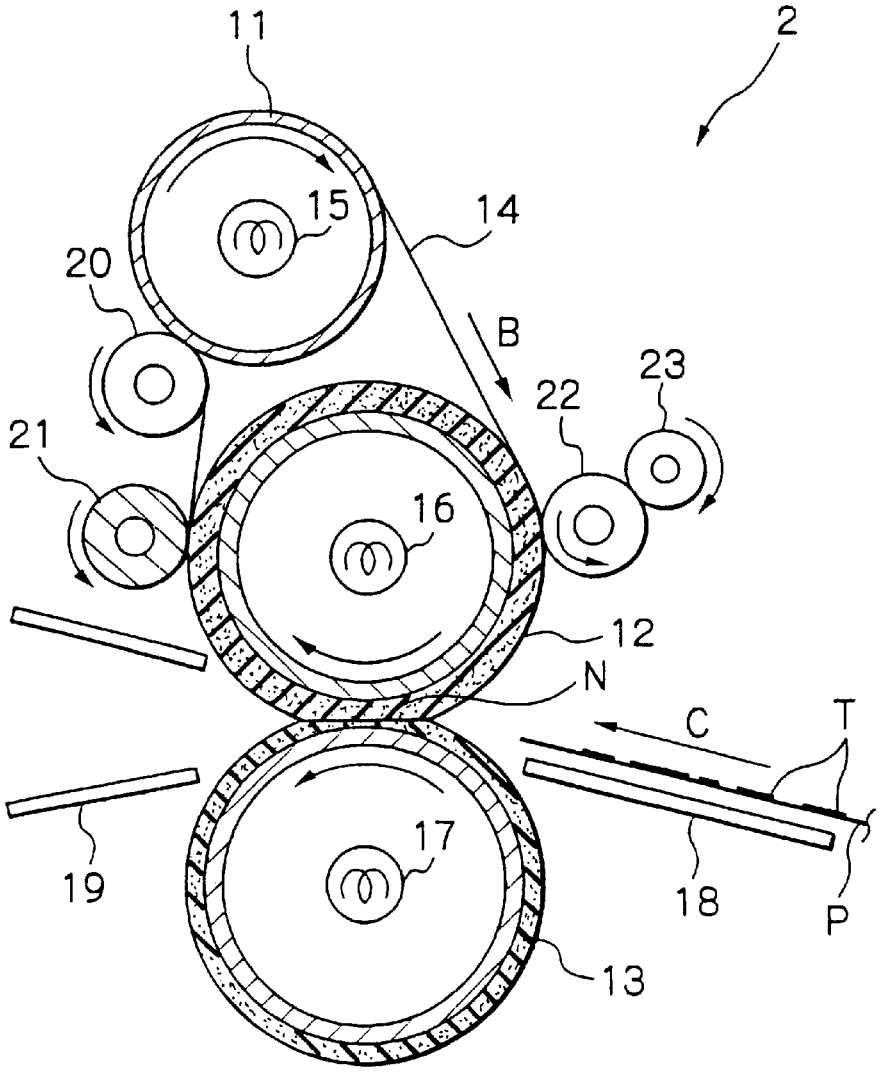
FIGS. 6 through 8 are sectional views, each showing another modification of the illustrative embodiment.

In the illustrative embodiment and modification thereof described above, the coating roller or contact member 22 is held in contact with part of the belt 14 that contacts the heat roller 11. When the heater 15 is turned on, but the belt 14 is not rotating, the coating roller 22 constantly takes heat from part of the belt 14 contacting the coating roller 22. However, this part of the belt 14 is constantly heated by the heat roller 11 and therefore prevented from being cooled off. It follows that on that start of an image forming operation the above part of the belt 14 is prevented from releasing much heat to the toner on the recording medium P and making fixation defective. This allows the warm-up time of the fixing device to be effectively reduced. For the same reason, when the heater 16 heats the fixing roller 12, the coating roller 22 may be held in contact with part of the belt 14 contacting the fixing roller 12, as shown in FIG. 6.

Assume that the coating roller 22 contacts part of the belt 14 contacting neither one of the heat roller 11 and fixing roller 12. Then, at the time of warm-up, the coating roller 22, which is not fully warmed, takes much heat from part of the belt 14 contacting the coating roller 22 because of the small thermal capacity of the belt 14, lowering the temperature of the above part of the belt 14. Consequently, when the above part of the belt 14 reaches the nip N at the beginning of movement of the bel 14, it cannot give a sufficient amount of heat to the toner and makes fixation defective. This is why the coating roller 22 contacts the heat roller 11 or the fixing roller 12 with the intermediary of the belt 14, as stated earlier.

The tension roller 20, cleaning roller 21 and tension/cleaning roller 26 each may also contact part of the belt 14 contacting the heat roller 11 or part of the same contacting the fixing roller 12 for the above-described reason. FIG. 6 shows another modification of the illustrative embodiment. As shown, the cleaning roller 21 contacts the fixing roller 12 to be heated by the heater 16 in the same manner as in FIG. 2. In this modification, the tension roller 20 contacts part of the belt 14 contacting the heat roller 11 to be heated by the heater 15.

Figure 7:
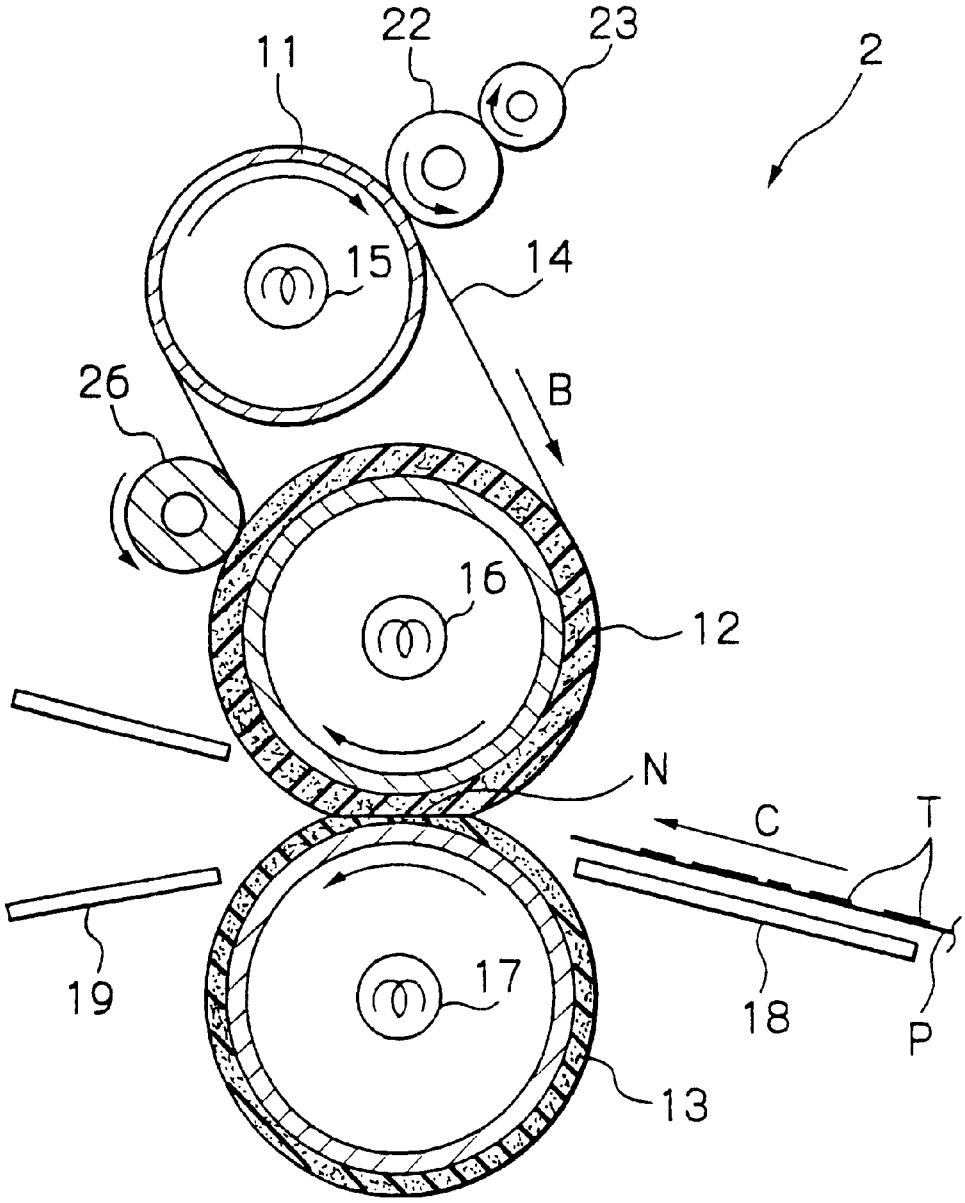
Figure 8:
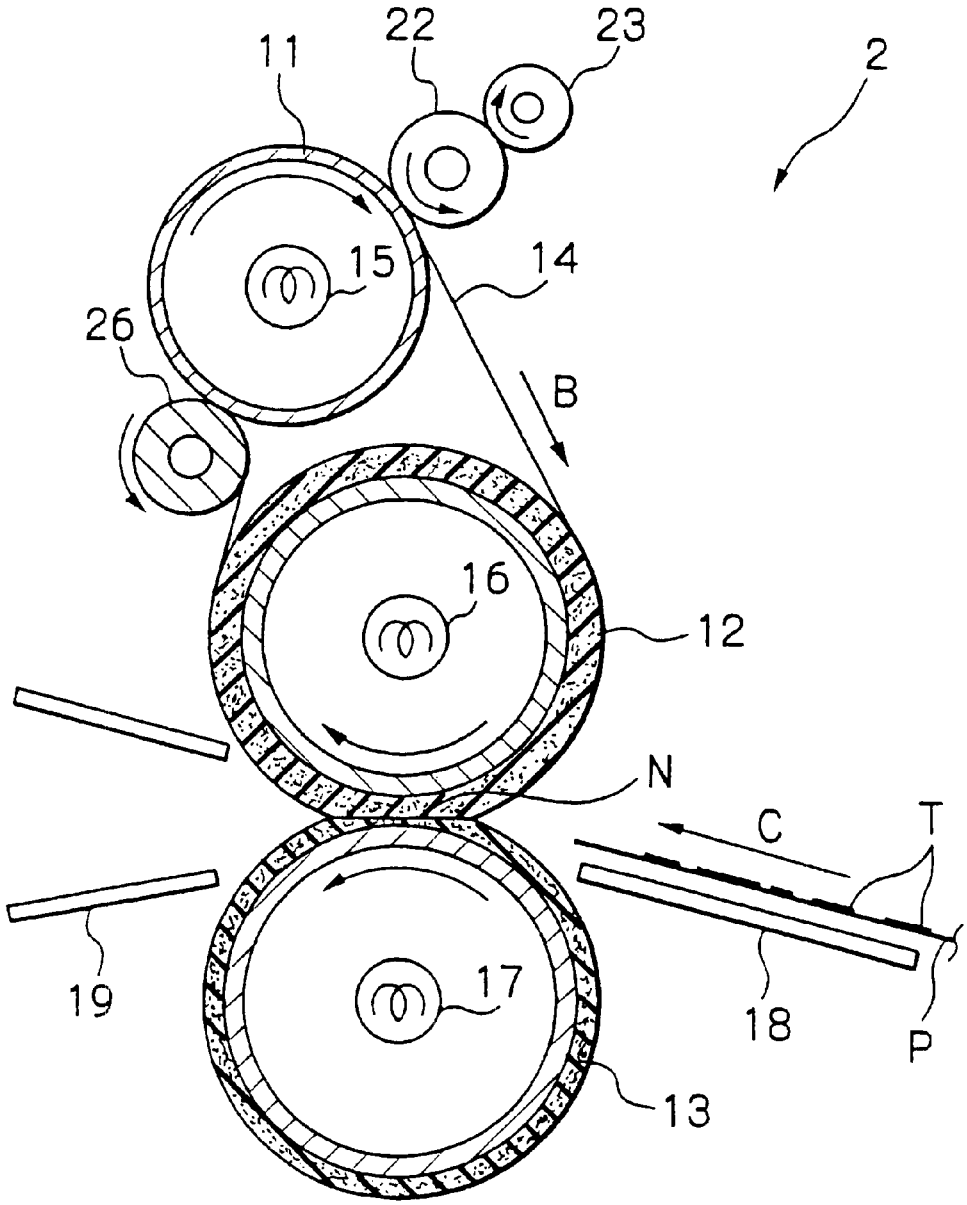

FIG. 7 shows still another modification of the illustrative embodiment. As shown, the tension/cleaning roller 26 contacts part of the belt 14 contacting the fixing roller 12, which is heated by the heater 16. FIG. 8 shows a further modification of the illustrative embodiment. As shown, the tension/cleaning roller 26 contacts part of the belt 14 contacting the heat roller 11, which is heated by the heater 15.

As stated above, at least one contact member should preferably contact part of the belt 14 contacting the heat roller 11. Likewise, at least one contact member should preferably contact part of the belt 14 contacting the fixing roller 12. This configuration surely reduces the warm-up time of the fixing device 2.

It is to be noted that the present invention is applicable to a broad range of image forming apparatuses including the apparatus shown in FIG. 1.

In summary, it will be seen that the present invention provides a simple, low-cost fixing device capable of being warmed up in a short period of time, and an image forming apparatus including the same.

Various modifications will become possible for those skilled in the art after receiving the teachings of the present disclosure without departing from the scope thereof.

What is claimed is:

1. A fixing device for fixing a toner image formed on a recording medium, comprising:

a heat roller;

a fixing roller;

an endless belt passed over said heat roller and said fixing roller and driven to turn;

a press roller pressed against said fixing roller with the intermediary of said endless belt, the recording medium being passed between said belt and said press roller; and at least two contact members contacting said belt, wherein part of said at least two contact members contacting said belt is formed of at least one of heat-resistant felt or heat-resistant resin.

2. The device as claimed in claim 1, wherein one of said at least two contact members comprises either one of a tension roller for applying tension to said belt or a cleaning roller for cleaning a surface of said belt.

3. The device as claimed in claim 1, wherein one of said at least two contact members comprises a tension cleaning roller for applying tension to said belt and cleaning a surface of said belt.

4. The device as claimed in claim 1, wherein said fixing roller is a heat roller.

5. A fixing device for fixing a toner image formed on a recording medium, comprising:

at least two heat rollers;

a fixing roller;

an endless belt passed over at least one of said at least two heat rollers and said fixing roller and driven to turn;

a press roller pressed against said fixing roller with the intermediary of said endless belt, the recording medium being passed between said belt and said press roller; and at least one contact member contacting said belt, wherein said at least one contact member contacts a surface of part of said belt contacting said heat roller.

6. An image forming apparatus comprising:

image forming means for forming a toner image on a recording medium; and a fixing device for fixing a toner image formed on a recording medium;

said fixing device comprising:

a heat roller;

a fixing roller;

an endless belt passed over said heat roller and said fixing roller and driven to turn;

a press roller pressed against said fixing roller with the intermediary or said endless belt, the recording medium being passed between said belt and said press roller; and at least two contact members contacting said belt, wherein part of said at least two contact members contacting said belt is formed of at least one of heat-resistant felt or heat-resistant resin.

7. The apparatus as claimed in claim 6, wherein said fixing roller is a heat roller.

8. An image forming apparatus comprising:

an image forming means for forming a toner image on a recording medium; and a fixing device for fixing a toner image formed on a recording medium;

said fixing device comprising:

at least two heat rollers;

a fixing roller;

an endless belt passed over at least one of said at least two heat rollers and said fixing roller and driven to turn;

a press roller pressed against said fixing roller with the intermediary of said endless belt, the recording medium being passed between said belt and said press roller; and at least one contact member contacting said belt, wherein said at least one contact member contacts a surface of part of said belt contacting said heat roller.

* * * * *